US006954953B2

(12) United States Patent
Bordan

(10) Patent No.: US 6,954,953 B2
(45) Date of Patent: Oct. 18, 2005

(54) NOVELTY CUSHION

(76) Inventor: Nancy C. Bordan, 518 SW. 6th Ave., Fort Lauderdale, FL (US) 33315

( * ) Notice: Subject to any disclaimer, the term of this patent is extended or adjusted under 35 U.S.C. 154(b) by 0 days.

(21) Appl. No.: 10/881,885

(22) Filed: Jun. 30, 2004

(65) Prior Publication Data

US 2005/0000021 A1 Jan. 6, 2005

Related U.S. Application Data

(60) Provisional application No. 60/483,966, filed on Jul. 1, 2003.

(51) Int. Cl.[7] ..... A47C 20/00

(52) U.S. Cl. ..... 5/648; 5/630; 128/882

(58) Field of Search ..... 128/882, 892, 128/894; 5/630, 632, 648, 650

(56) References Cited

U.S. PATENT DOCUMENTS

| | | | | | |
|---|---|---|---|---|---|
| 4,177,806 | A | * | 12/1979 | Griffin | 128/892 |
| 5,117,522 | A | * | 6/1992 | Everett | 5/648 |
| 5,216,771 | A | * | 6/1993 | Hoff | 5/648 |
| 5,746,218 | A | * | 5/1998 | Edge | 128/845 |
| 6,640,368 | B2 | * | 11/2003 | Roston | 5/648 |

* cited by examiner

*Primary Examiner*—Michael Trettel

(57) ABSTRACT

A novelty cushion is disclosed including a plurality of grooves on a first side, a plurality of grooves on a second side, the second side opposite the first side, and wherein the at least two grooves of the plurality of grooves on the first side are substantially perpendicular to one another and wherein at least two grooves of the plurality of grooves on the second side are substantially perpendicular to one another.

2 Claims, 2 Drawing Sheets

NOVELTY CUSHION

CROSS-REFERENCES TO RELATED APPLICATIONS

This application claims the benefit of U.S. Provisional Application Ser. No. 60/483,966, filed on Jul. 1, 2003, entitled NOVELTY CUSHION.

TECHNICAL FIELD

This invention relates generally to cushions. More particularly, the present invention relates to a knee cushion for separating the knees of a person while lying on their side.

BACKGROUND OF THE INVENTION

The use of pillow or cushion devices is known in the prior art. More specifically, pillow or cushion devices heretofore devised and utilized are known to consist basically of familiar, expected and obvious structural configurations, notwithstanding the myriad of designs encompassed by the crowded prior art that have been developed for the fulfillment of countless objectives and requirements.

Previous attempts have been made and patented in regard to the aforementioned devices and, in particular, to pillows used to provide support and align various parts of an individual's body. Generally, prior patents disclose pillows or cushions which are of such length that they are utilized all along the body of the user, rather than in a novel concept of the present invention wherein a cushion with substantially perpendicular grooves is specifically made to fit between the knees of a user.

SUMMARY OF THE INVENTION

The present invention eliminates the above-mentioned needs for a knee cushion by providing a knee cushion including a plurality of grooves to accommodate the knees and adjacent leg regions.

In accordance with the present invention, there is provided a knee cushion having a plurality of grooves on a first side, a plurality of grooves on a second side, and wherein the at least two grooves of the plurality of groove on the first side and at least two grooves of the plurality of groove on the second side are substantially perpendicular to one another.

Additionally, the present invention can include a fabric covering for additional comfort, breathability, and durability.

DETAILED DESCRIPTION OF THE PREFERRED EMBODIMENT

Figure 1:
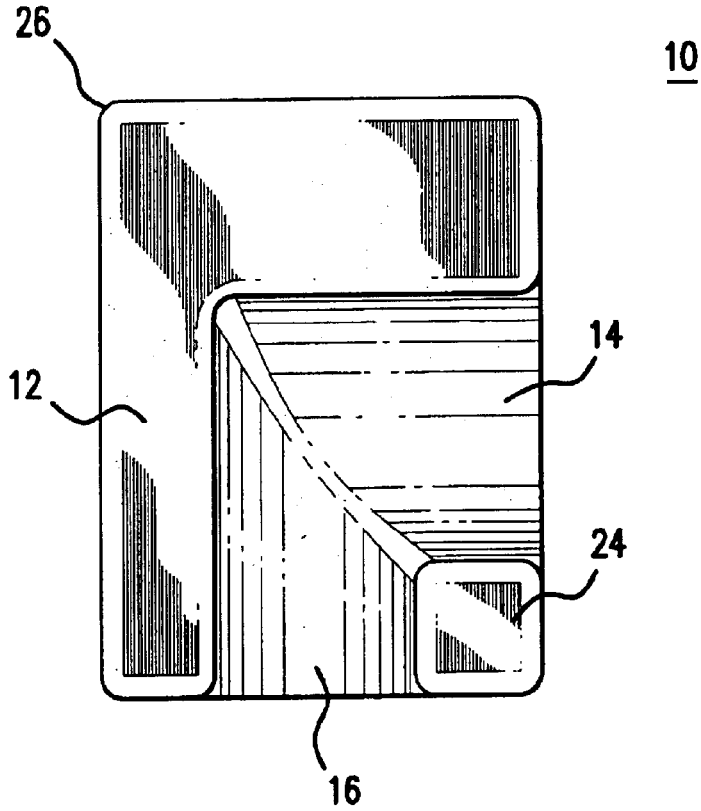
FIG. 1 is a top view illustration of the preferred embodiment of the present invention.
Figure 2:
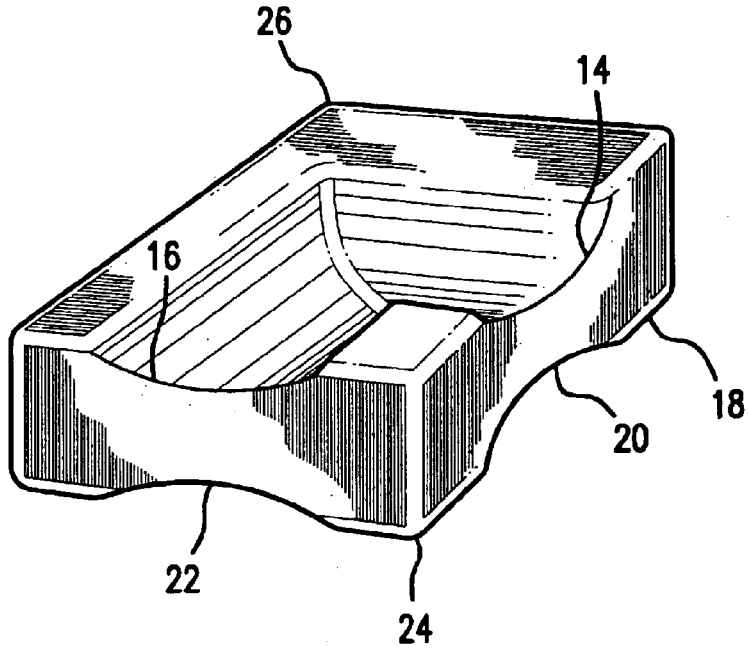
FIG. 2 is an isometric view illustration of the present invention of FIG. 1.

Referring now to FIGS. 1 and 2, the preferred embodiment of the present invention is illustrated as cushion 10. Cushion 10 includes first side 12 having first side grooves 14 and 16, and second side 18 having second side grooves 20 and 22. Grooves 14 and 16 are substantially perpendicular to one another, as are grooves 20 and 22, so as to facilitate comfort for a user by allowing the knees of the user to be positioned in a bent position.

Referring again to FIG. 1, it is preferred that cushion 10 be further provided with a rear portion 24. Rear portion 24 is formed from cushion 10 opposite corner 26 so as to provide a structure that fits within the bent knee joint of the user.

Referring again to FIG. 2, it is further preferred that the distance between first side groove 14 and second side groove 20 be such that even under the weight of the user's supported leg portions, adequate distance between first side groove 14 and second side groove 20 remains to comfortably separate the knees of the user. Likewise, it is further preferred that the distance between first side groove 16 and second side groove 22 be such that even under the weight of the user's supported leg portions, adequate distance between first side groove 16 and second side groove 22 remains to comfortably separate the knees of the user.

Preferably, cushion 10 is composed of a material that is resiliently compressible and capable of retaining its shape upon removal of compression forces applied by the user. By way of example, which is not meant to be limiting in any manner whatsoever, such materials are often referred to as "memory foams" that, when compressed, retain a "memory" of their original shape and are well known in the art. Types of foams can include, but are not limited to, molded polyethylene soft foams, molded polyurethane soft foams, and various similar foams, as are used in chair cushions and the like.

Figure 3:
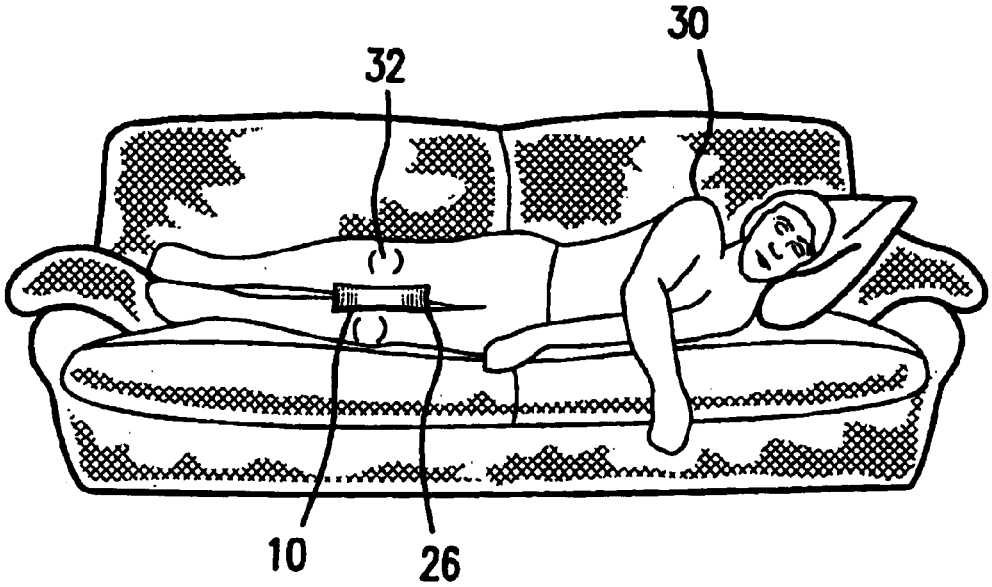
FIG. 3 is a front view of the preferred embodiment of the present invention of FIG. 1 in operation.

In operation, as illustrated in FIG. 3, a user 30 arranged on his side positions cushion 10 between his knees 32 for the intended use. Preferably, cushion 10 is positioned between knees 32 of user 30 so that knees 32 fit into first side grooves 14 and 16 and second side grooves 20 and 22 such that rear portion 24 (illustrated in FIGS. 1 and 2) fits within the bent knee joint of the user, and thereby positioning corner 26 at the front of knees 32. As a result of the distance between first side groove 14 and second side groove 20 and first side groove 16 and second side groove 22, the weight of the user's supported leg portions, including knees 32, adequate distance between first side groove 14 and second side groove 20 and first side groove 16 and second side groove 22 remains to comfortably separate knees 32 of user 30 providing a measure of comfort between knees 32 that would not exist otherwise.

Cushion 10 can additionally incorporate a non-removable fabric covering (not shown) for user comfort, as well as for protection from excessive wear. Such non-removable fabric covering is preferably machine washable, as is the foam encased therein. A removable fabric covering can be customized so as to fit over non-removable fabric covering and cushion 10, thereby allowing the user to select desired colors, patterns and the like, akin to a pillow/pillow case arrangement.

Although only a few exemplary embodiments of the present invention have been described in detail above, those skilled in the art will readily appreciate that numerous modifications to the exemplary embodiments are possible without materially departing from the novel teachings and advantages of this invention. Accordingly, all such modifications are intended to be included within the scope of this invention as defined in the appended claims.

What is claimed is:

1. A novelty cushion comprising:

a plurality of grooves on a first side;

a plurality of grooves on a second side, said second side opposite said first side; and wherein said at least two grooves of said plurality of grooves on said first side are substantially perpendicular to one another and wherein at least two grooves of said plurality of grooves on the second side are substantially perpendicular to one another, and wherein said cushion is covered by non-removable fabric covering.

2. The novelty cushion according to claim 1 wherein said non-removable fabric covering is further covered by a removable fabric covering.

* * * * *